United States Patent [19]

Miyoshi

[11] 4,181,857

[45] Jan. 1, 1980

[54] X-RAY APPARATUS FOR A COMPUTED TOMOGRAPHY SCANNER

[75] Inventor: Katsuhiko Miyoshi, Sagamihara, Japan

[73] Assignee: Tokyo Shibaura Electric Co., Ltd., Japan

[21] Appl. No.: 838,369

[22] Filed: Sep. 30, 1977

[30] Foreign Application Priority Data

Sep. 30, 1976 [JP] Japan ..... 51/117560

[51] Int. Cl.[2] ..... H05G 1/30

[52] U.S. Cl. ..... 250/402; 250/417; 250/413

[58] Field of Search ..... 250/402, 417, 418, 421, 250/413, 408, 409

[56] References Cited

U.S. PATENT DOCUMENTS

| | | | |
|---|---|---|---|
| 2,129,646 | 9/1938 | Bouwers | 250/402 |
| 3,069,548 | 12/1962 | Bavor | 250/402 |

FOREIGN PATENT DOCUMENTS 1283915 8/1972 United Kingdom .

*Primary Examiner*—Craig E. Church
*Attorney, Agent, or Firm*—Finnegan, Henderson, Farabow & Garrett

[57] ABSTRACT

An X-ray apparatus for a computed tomography scanner comprises a capacitor device formed of a plurality of capacitors which have the same capacitance and are successively connected to a first changeover switch between the filament and anode of an X-ray tube. There are connected in series between the anode of the X-ray tube and the first changeover switch a high voltage switch for intermittently applying a high voltage across the anode and filament of the X-ray tube and a wave tail cut circuit whose contact is opened when a drop takes place in the voltage of the capacitor connected to the first changeover switch. The capacitor device is connected to the secondary winding of a high voltage transformer through a second changeover switch and a diode connected to the plural capacitor in turn. Between the second changeover switch and the secondary winding of the high voltage transformer are connected a rectifier and the contact of a charge-interrupting circuit which is opened when a rise occurs in the voltage of the capacitor connected to the second changeover switch. The plural capacitors of the capacitor device are successively charged with high voltage of a prescribed level. The high voltage of the prescribed level with which the plural capacitors of the capacitor device are charged is successively applied at a short interval across the filament and anode of the X-ray tube, which emits the prescribed amount of X-radiation succession of short burst.

5 Claims, 5 Drawing Figures

X-RAY APPARATUS FOR A COMPUTED TOMOGRAPHY SCANNER

This invention relates to an X-ray apparatus for a computed tomography scanner and more particularly to a high voltage-generating device for applying high voltage to an X-ray tube for a computed tomography scanner.

Various types of computed tomography scanners (hereinafter referred to as "a CT scanner") known to date include that described in U.S. Pat. No. 3,965,357 representing an early type of X-ray device for a computed tomography scanner. That system comprises a single X-ray source and a single X-ray-detecting cell. U.S. Pat. No. 3,983,393 shows a system comprising a single X-ray source and a plurality of X-ray detector cells. Recently, another type of CT scanner has been developed which comprises a plurality of X-ray sources and corresponding X-ray-detecting cells for detecting a dosage of X-rays.

With any type of CT scanner, the X-ray tube thereof must emit the exact prescribed amount of X-radiation. The x-ray tube used with a CT scanner is required to emit a more accurately prescribed amount of X-radiation than the ordinary diagnostic X-ray device. The X-ray tube should emit the prescribed amount of X-rays to a foreground subject, for example, the head of a patient in the form of short interval pulses ranging between about 100 milliseconds and 1 second. The reason why the X-ray tube of the CT scanner should give off the exact prescribed amount of X-rays in the form of pulses at a short interval is that it is necessary to decrease the total dosage of X-rays radiated, and that unlike the ordinary diagnostic X-ray device, the X-ray device for the CT scanner must emit the prescribed amount of X-rays to a foreground subject from different positioning surrounding the subject, and a tomographic image of the foreground subject is prepared from a large number of data samples obtained by comparison between the strength of the emitted X-rays and the X-rays penetrating the foreground subject. If, in this case, the dosage of X-rays varies, each time X-rays are projected to a foreground subject from surrounding positions, then a tomographic image resulting from the irregular dosage of X-rays will become unreliable, making it impossible to reproduce an accurate tomographic image. Further, where irradiation of the subject consumes a great deal of time, then the subject will have to be kept at rest for an undue period of time. If, under this condition, the foreground subject should make any slight movement, then the CT scanner will provide in-accurate data. Further, if the subject is a human body, lengthy continuous projection of a large amount of X-radiation will exert harmful effects on the human body.

The amount of X-radiation delivered by the X-ray tube is generally determined by the level of high voltage applied across the anode and cathode of the X-ray tube. If high voltage of the prescribed level is always applied across the anode and cathode of the X-ray tube at short intervals, then the X-ray tube should emit the prescribed amount of X-radiation at each short interval. Where, however, fluctuations occur in the voltage of the power source connected to the tube via a high voltage transformer causing fluctuations in the high voltage supplied to the X-ray tube, then it will be extremely difficult to apply the prescribed level of high voltage to the X-ray tube and to emit the prescribed amount of X-radiation at the required accurately defined intervals.

It is accordingly an object of this invention to provide an X-ray apparatus for a computed tomography scanner which can apply high voltage of the prescribed level to the X-ray tube at short intervals and which enables X-ray imaging to be completed in a short time.

According to an aspect of this invention, there is provided an X-ray device for a computed tomography scanner, which comprises a first changeover switch means whose connection is successively changed over intermittently; a capacitor device formed of a plurality of capacitors which have the same capacitance and are successively connected to an X-ray tube through the first changeover switch means, being applied high voltage with which said capacitors are to be charged to the X-ray tube; first voltage supply-interrupting means one end of which is connected to the first changeover switch means, the other end of which is connected to a circuit through which each capacitor applies high voltage to the X-ray tube, detects a drop to the prescribed level in the voltage of said capacitor when its high voltage is discharged, and interrupts supply of voltage on the X-ray tube; a second changeover switch means which is successively connected to different capacitors than those which are connected to the first changeover switch means; a voltage source which is connected through the second changeover switch means to the capacitor connected to said second changeover switch means, thereby applying a charge voltage on the capacitor connected to the second changeover switch means; and second voltage supply-interrupting means which is connected to a circuit through which the high voltage source applies a charge voltage to the capacitor, and detects the prescribed rise in the voltage of the capacitor connected to the second changeover switch means to be charged, thereby interrupting voltage supply to the capacitor.

This invention can be more fully understood from the following detailed description when taken in conjunction with the accompanying drawings, in which.

There will now be described by reference to the accompanying drawings the X-ray apparatus of this invention as employed in a computed tomography scanner.

Figure 1:
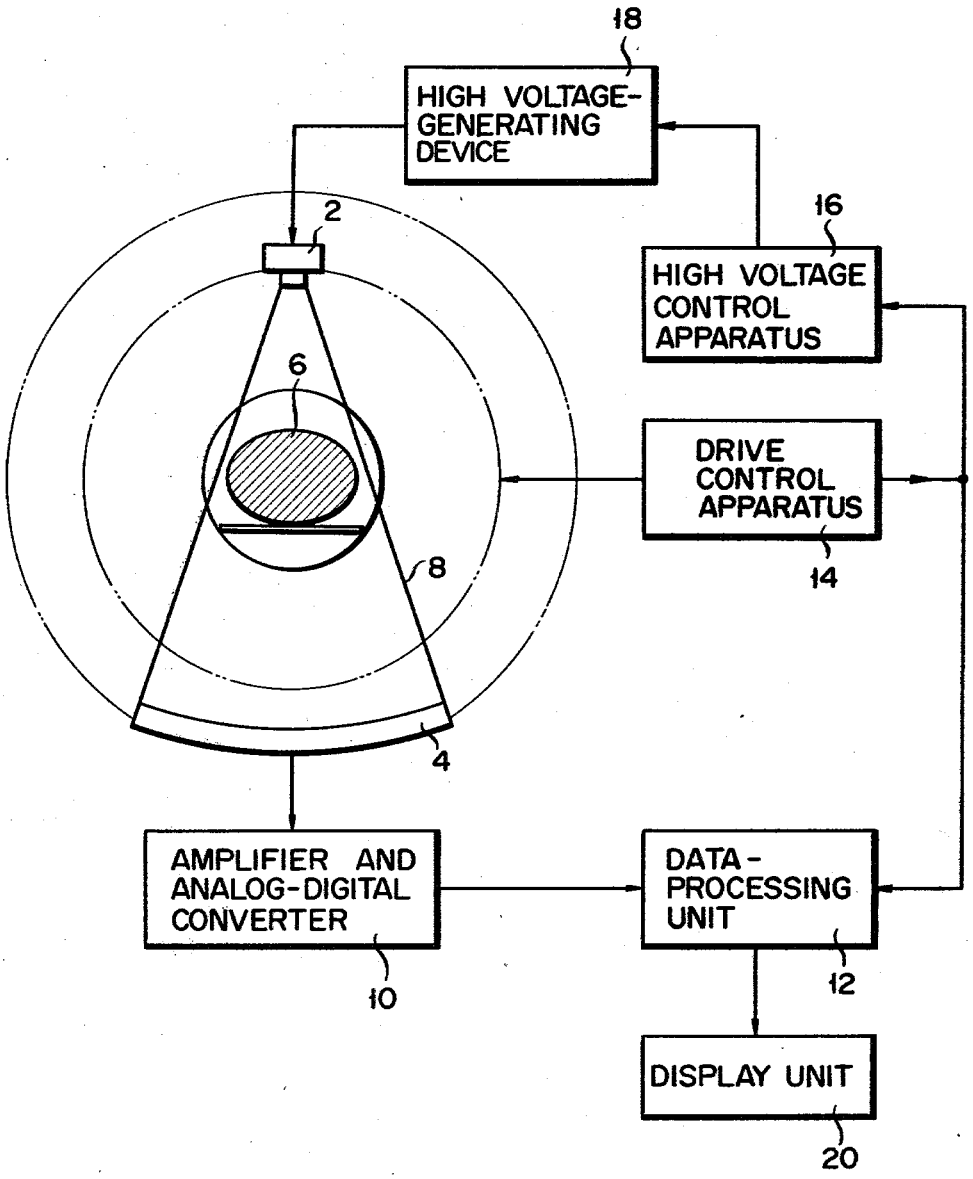
FIG. 1 is a schematic diagram of a computed tomography scanner.

First, a brief description is given of the CT scanner by reference to FIG. 1. The CT scanner of FIG. 1 is of the same type as that set forth in copending U.S. patent application Ser. No. 815,360 filed by the assignee of the present application. This CT scanner comprises a single X-ray source 2, and an X-ray detector 4 formed of a plurality of X-ray detecting cells. A fan-shaped beam 8 of X-rays emitted from the X-ray source 2 and passed through a foreground subject 6 is detected by the detector 4. The X-ray source 2 and detector 4 face each other across the foreground subject 6, and travel around the foreground subject 6 in a circular scan indicated by the dot-dash line in FIG. 1. The X-ray source 2 emits the fan-shaped beam 8 of X-rays each time the elements 2, 4 are moved through a prescribed circumferential angle in the circular scan. Therefore, the fan-shaped beam 8 repeatedly penetrates the foreground subject 6. The respective detecting cells of the detector 4 detect the amount of X-radiation which has passed through the foreground subject 6, and supply an amplifier and analog-digital converter 10 with signals corresponding to the different areas of the foreground subject 6 penetrated by the X-rays. The data signals are amplified and converted into digital signals by the amplifier and analog-digital converter 10 and are conducted to a data-processing unit 12 to be temporarily stored in a memory.

A drive control apparatus 14 for controlling the operation of the CT scanner supplies data on the position of the X-ray source 2 to the data-processing unit 12 and a high voltage control apparatus 16. This high voltage control apparatus 16 controls the operation of a high voltage-generating device 18 for applying a high voltage to the X-ray source or X-ray tube 2. While moving through the circular scan, the X-ray source 2 repeatedly gives off the fan-shaped beam 8 of X-rays. Thus the memory of the data-processing unit 12 is supplied with many data signals denoting the amounts of X-radiation beams penetrating the different tissue areas of the foreground subject 6 from many different angles surrounding the subject. The data signals stored in the memory, and the data signals representing the different positions of the X-ray source 2 which are supplied from the drive-control apparatus 14 are collectively converted into tomographic image signals by the data-processing unit 12. A display unit 20 supplied with the tomographic image signals displays the tomographic images of the foreground subject 6. With the CT scanner, the more accurate the data on the tomographic images of the foreground subject, the more distinct the images indicated by the display device 20. To this end, it is very important that each burst of X-rays emitted by the X-ray source 2 have the exactly prescribed dosage. Since it is generally required to generate the tomographic images during a short period, the X-ray source 2 must emit X-rays as frequently as 180 times during a series of short intervals occurring, for example, every 150 milliseconds, i.e., at a repetition rate of 6.67 pulses per second.

For emission of the prescribed amount of X-rays during each short interval, it is necessary that the high voltage-generating device 18 produce a high voltage output of the exact prescribed level periodically at the same high repetition rate.

Figure 2:
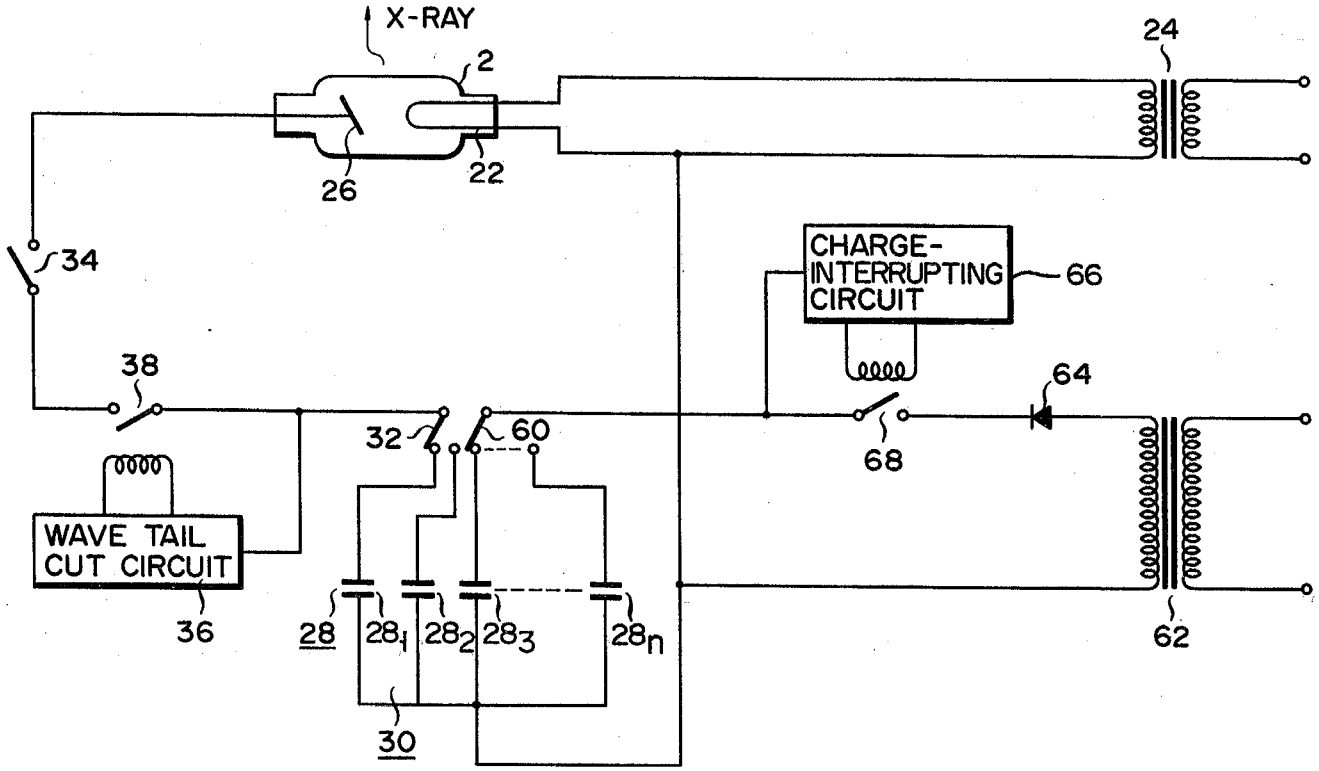
FIG. 2 is a circuit diagram of an X-ray apparatus illustrating an embodiment of this invention as may be employed in a computed tomography scanner.

An X-ray apparatus embodying this invention for use in a CT scanner comprises a high voltage-generating device 18 arranged as shown in FIG. 2 to apply a high voltage of the exact prescribed level to the X-ray tube in the required rapid sequence of short intervals.

The filament 22 of the X-ray tube of FIG. 2 is connected to the secondary winding of a filament transformer 24. The primary winding of the filament transformer 24 is connected to a power source through the constant voltage-generating device and filament current-varying device (neither shown) of the high voltage control apparatus 16. A capacitor device 30 is formed of a plurality of capacitors 28 having the same capacitance of, for example, 1 microfarad functioning intermittently to apply high voltage of the prescribed level to the X-ray tube 2. The capacitor device 30 is connected between the anode 26 and filament 22 of the X-ray tube 2 through the first changeover switch 32 for successively connecting the plural capacitors 28 between the anode 26 and filament 22 of the X-ray tube 2. The first changeover switch 32 may be of an electric type formed of, for example, a triode, or a mechanical type.

Connected between the first changeover switch 32 and X-ray tube 2 is a relay contact 38 of a wave tail cut circuit 36 which is opened when the voltage of the capacitor 28 of the capacitor device 30 drops to a prescribed threshold level when said capacitor 28 is discharged. Where the first changeover switch 32 is of an electric type, there are connected in series between the first changeover switch 32 and X-ray tube 2 a high voltage switch 34 which, when the first changeover switch 32 is closed, is also closed afterward, and when the first changeover switch 32 is opened, is also opened before that time, thereby suppressing the arc which tends to appear at the contact of the first changeover switch 32, and the relay contact 38 of the wave tail cut circuit 36 which is opened when the voltage of the capacitor 28 of the capacitor device 30 connected to the first changeover switch 32 drops to the prescribed threshold level when said capacitor 28 is discharged. The wave tail cut circuit 36 detects the voltage across the capacitor 28. When the voltage falls to the prescribed level, then the relay of the wave tail cut circuit 36 is actuated to open the relay contact 38.

Figure 3:
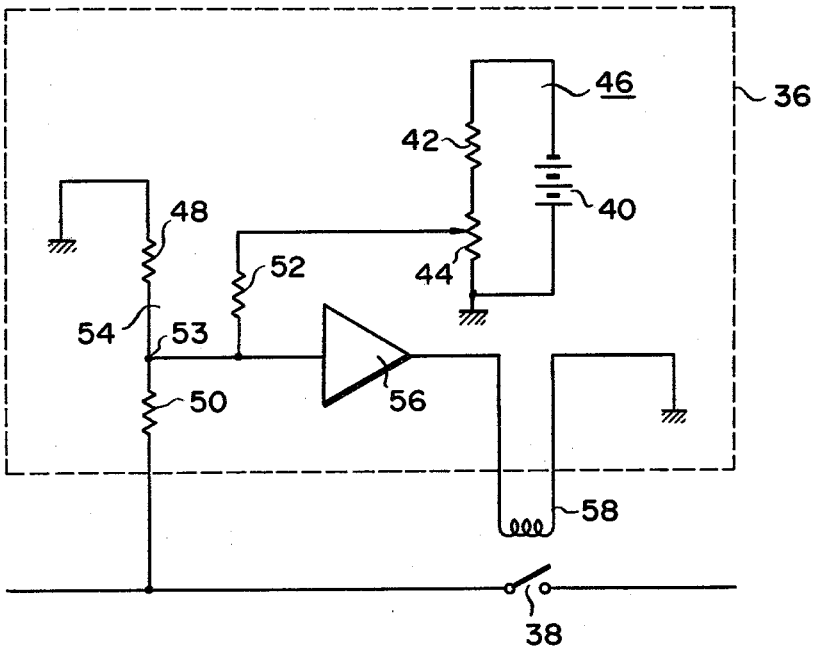
FIG. 3 is a circuit diagram of the wave tail cut circuit of FIG. 2.

FIG. 3 shows the arrangement of the wave tail cut circuit 36. As used herein, the term "cutting-off of a wave tail" is defined to mean the cutting-off of that portion or tail of the transiently varying voltage or current of a circuit which falls below the prescribed level.

The wave tail cut circuit 36 of FIG. 3 comprises a potentiometer 46 formed of a DC power source 40, resistor 42 and variable resistor 44; a voltage comparator 54 formed of a resistor 50 of relatively high resistance connected to the first changeover switch 32 and grounded through a resistor 48, and a resistor 52 connected between the sliding contact of the variable resistor 44 and the junction 53 of the two resistors 48, 50; an operational amplifier 56 whose input terminal is connected to the junction 53 of the two resistors 48, 50; and a relay 58 connected to the output terminal of the operational amplifier 56.

The resistors 48, 50 are supplied with the voltage of the capacitor 28 which is divided according to the ratio of the resistors 48, 50. Where coincidence exists between the voltage at junction 53 and a reference voltage determined by the potentiometer 44, then the operational amplifier 56 generates an output to open relay contacts 38. This general arrangement of voltage detection circuit is known to those skilled in the art and may be modified to suit the particular requirements of the system.

Referring to FIG. 2, the capacitor device 30 is connected to a voltage source, for example, a high voltage transformer 62 through a second changeover switch 60 which is successively connected to the plural capacitors 28 of the capacitor device 30 to charge the capacitors in turn to the prescribed voltage level. Connected in series between the second changeover switch 60 and the secondary winding of the high voltage transformer 62 are a diode 64 for supplying rectified current from the high voltage transformer 62 to the respective capacitors 28 and a relay contact 68 of a charge-interrupting circuit 66 which is closed when the capacitor 28 connected to the second changeover switch 60 is charged with a lower prescribed level of voltage than that of a high voltage supplied from the secondary winding of the high voltage transformer 62. The charge interrupting circuit 66 which causes the relay contact 68 to be opened when detecting that the capacitor 28 connected to the second changeover switch 60 has been charged to a high voltage of the prescribed level. The charge-interrupting circuit 66 may have the same arrangement as the wave tail cut circuit 36 of FIG. 3, or such other arrangement as may be suited to the requirements of the system.

It should be understood, however, that the relay function provided by the circuit 66 is opposite to that provided by the circuit 36 in that a voltage above the threshold of circuit 36 closes the contacts 38 while a voltage above the threshold of circuit 66 opens the contacts 68. This difference in function may be obtained, for example, by inverting the output of the operational amplifier.

It is preferred that the reference potential defined by the potentiometer 46 of the wave tail cut circuit 36 and the reference potential defined by the potentiometer employed in the charge-interrupting circuit 66 be changed in predetermined relationship. Namely, it is desired that the sliding contacts of the variable resistors used with the potentiometers of the wave tail cut circuit 36 and the charge-interrupting circuit 66 be cooperatively shifted such that where the reference potential of the potentiometer 46 of the wave tail cut circuit 36 is set at, for example, 40 KV, then that set by the potentiometer of the charge-interrupting circuit 66 stands at 60 KV, and further where the reference potential of the potentiometer of the wave tail cut circuit 36 is increased to 110 KV, then that set by the potentiometer of the charge-interrupting circuit 66 rises to 150 KV.

Like the first changeover switch 32, the second changeover switch 60 may be of a mechanical or electrical type. The secondary winding of the high voltage transformer 62 is connected to a power source through an autotransformer (not shown) provided in the high voltage control apparatus 16. The high voltage applied to the secondary winding of the high voltage transformer 62 varies as the primary voltage of said high voltage transformer 62 is adjusted by the autotransformer.

Figure 4:
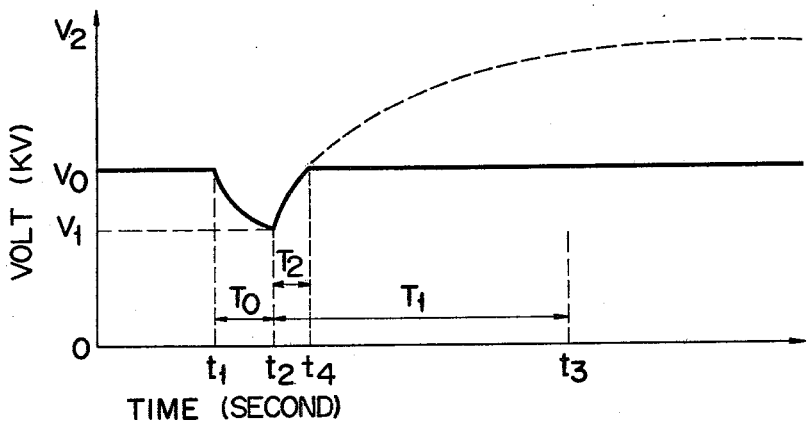
FIG. 4 is a graph indicating changes with time in the voltage of each of the capacitors of the capacitor device of FIG. 2.

The high voltage-generating device 18 for the above-mentioned CT scanner applies a high voltage to the X-ray tube 2 intermittently as described below.

Where the respective capacitors 28 are charged with high voltage of the prescribed level $V_0$, then a first capacitor $28_1$ is connected to the first changeover switch 32. Since, at this time, the high voltage switch 34 still remains opened, the high voltage with which the first capacitor $28_1$ is charged does not give rise to an arc in the first changeover switch 32. Further, since, at this time, the first capacitor $28_1$ is charged with high voltage of the prescribed level, the relay contact 38 of the wave tail cut circuit 36 connected to said first capacitor $28_1$ is closed. Later at time $t_1$ shown in FIG. 4 when the high voltage switch 34 is closed, the high voltage $V_0$ of the first capacitor $28_1$ is applied across the filament 22 and anode 26 of the X-ray tube 2. The high voltage $V_0$ of the first capacitor $28_1$ gradually falls as shown in FIG. 4 as the capacitor is discharged. Where the high voltage $V_0$ drops to the reference voltage $V_1$ (generally 40 to 110 KV) which is previously determined by the wave tail cut circuit 36, then the relay of the wave tail cut circuit 36 is actuated, causing the relay contact 38 to be opened at time $t_2$. Where coincidence takes place between a voltage corresponding to the voltage of the first capacitor $28_1$ which appears at the junction 53 of the voltage comparator 54 of the wave tail cut circuit 36 (FIG. 3) and the reference voltage of the potentiometer 46 which is indicated at said junction 53, then the operational amplifier 56 and in consequence the relay 58 thereof are actuated to open the contact 38 of said relay 58. Some time afterward, the high voltage switch 34 is opened.

Figure 5:
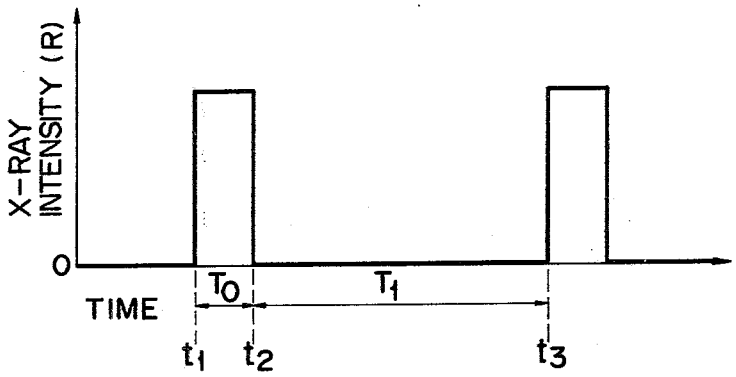
FIG. 5 is a graph showing a time interval during which an X-ray tube intermittently emits X-rays.

As seen in FIG. 5, a high voltage is applied across the filament 22 and anode 26 during a period $T_0$ extending from time $t_1$ when the high voltage switch 34 is closed to time $t_2$ when the relay contact 38 is opened. The X-ray tube 2 emits X-rays only during the period $T_0$. This period $T_0$ may range between 0.1 millisecond and 10 milliseconds.

Where the high voltage switch 34 is opened, then a second capacitor $28_2$ is connected to the first changeover switch 32. Where the high voltage switch 34 is closed thereafter at time $t_3$, then the X-ray tube 2 gives off X-rays as in the previous case. A rest period $T_1$ which extends from time $t_2$ when the relay contact 38 is opened to time $t_3$ when the high voltage switch 34 is closed again and during which X-rays are not emitted may range between 100 milliseconds and 1 second. Where, as mentioned above, the first changeover switch 32 is connected to the plural capacitors 28 in succession and the high voltage switch 34 is intermittently opened and closed, the X-ray tube 2 emits X-rays in a sequence of a very short intervals.

The first capacitor $28_1$ whose prescribed voltage $V_0$ has dropped to a level $V_1$ is again charged up to the prescribed voltage level $V_0$, before said first capacitor $28_1$ is connected to the first changeover switch 32. FIG. 4 is a time chart showing the time sequence in which the first capacitor $28_1$ begins to be charged again immediately after connection of the first changeover switch 32 is shifted from the first capacitor $28_1$ to the second capacitor $28_2$. If desired, a rest period $T_1$ may be allowed until the time arrives at which the capacitor 28 begins to be charged again after its prescribed voltage $V_0$ has fallen to the level $V_1$.

There will now be described by reference to FIGS. 2 and 4 the process by which the first capacitor $28_1$ begins to be charged again when the first changeover switch 32 is connected to the second capacitor $28_2$.

When the first changeover switch 32 is connected to the second capacitor $28_2$, then the second changeover switch 60 is connected to the first capacitor $28_1$. Since, at this time, the voltage of the first capacitor $28_1$ has as low a level as $V_1$, the relay contact 68 of the charge-interrupting circuit 66 (FIG. 2) is closed. Accordingly, when connected to the second changeover switch 60, the first capacitor $28_1$ is again charged by high voltage $V_2$ supplied through the high voltage transformer 62 and diode 64. Where the voltage of the first capacitor $28_1$ reaches the prescribed level $V_0$ lower than the aforesaid voltage $V_2$, then the charge-interrupting circuit 66 opens its relay contact 68, at time $t_4$, as is the case with the wave tail cut circuit 38, thereby preventing the first capacitor $28_1$ from being charged any further.

Where connection of the first changeover switch 32 is later shifted from the second capacitor $28_2$ to the third one $28_3$, then connection of the second changeover switch 60 is changed from the first capacitor $28_1$ to the second capacitor $28_2$, causing said second capacitor $28_2$ to be charged as described above. Since the voltage of the second capacitor $28_2$ stands at a low level when said second capacitor $28_2$ is connected to the second changeover switch 60, the relay contact 68 of the charge-interrupting circuit 66 closes. The length of time $T_2$ (FIG. 4) for which the second capacitor $28_2$ is charged generally ranges between 100 milliseconds and 1 second. The charging time $T_2$ is calculated from the following equation:

$$T_2 = R \cdot C \cdot \log_e(1 - \frac{V_0 - V_1}{V_2 - V_1})$$

Where:

R=equivalent resistance of the power source supposedly connected to the capacitor device 30

C=capacitance of the capacitor constituting $V_0$=level of voltage at which the charge-interrupting circuit 66 begins to stop charge, namely, level of voltage with which the capacitor is fully charged $V_1$=level of voltage cut off by the wave tail cut circuit 36, namely, level of voltage lower than that of the voltage discharged from the capacitor $V_2$=voltage of the secondary winding of the high voltage transformer 62 supplied to the capacitor device 30

Now let is be assumed that R is expressed by $3\times10^5\Omega$; C by $1\times10^{-6}$[F]; the voltage $V_1$ cut off by the wave tail cut circuit 36 has a 20% lower level than the level of voltage $V_0$ at which the charge-interrupting circuit 66 begins to stop charge; and the voltage of the secondary winding of the high voltage transformer 62 has a 30% higher level than the level of voltage $V_0$ at which the charge-interrupting circuit 66 begins to stop charge. Since $V_1=0.8V_0$ and $V_2=1.3V_0$, therefore $$T_2 = 1 \times 10^{-6} \times 3 \times 10^5 \log_e(1 - \frac{V_0 - 0.8V_0}{1.3V_0 - 0.8V_0}) = 0.153 \text{ sec}$$

Where, in this case, the period $T_0$ during which X-rays are emitted is 0.4 millisecond and the rest period $T_1$ is 120 milliseconds, then the length of time required for one capacitor to be charged is 153 milliseconds as described above. Therefore, one capacitor can not be fully charged during the above-mentioned rest period $T_1$. Where, however, at least two capacitors are provided, then one of them can be fully charged during a period to be charged independently about twice longer than the rest period $T_1$, that is, 240 milliseconds. Where, therefore, the high voltage-generating device 18 is provided with at least two capacitors which are charged independently, then high voltage of the prescribed level can always be repeatedly applied to the X-ray tube 2.

The foregoing description of the embodiment of this invention refers to the case where an X-ray apparatus for a CT scanner comprised one X-ray tube for emitting a fan-shaped beam of radiation and an X-ray detector formed of a plurality of X-ray-detecting cells. Obviously, this invention is not limited to the above-mentioned type of X-ray apparatus for the CT scanner, but may be applicable in many other modifications without changing the object and scope of the invention.

As mentioned above, the X-ray apparatus of this invention for the CT scanner can always apply high voltage of the exact prescribed voltage to the X-ray tube repeatedly during short intervals. Moreover, provision of a large number of capacitors shortens the time required for X-ray imaging, thereby exposing the foreground subject to a smaller amount of X-rays, and in consequence enabling the CT scanner to provide a tomographic image of high quality in a short time.

Moreover, the X-ray apparatus for the CT scanner has a sufficiently simple circuit arrangement to be marketed at low cost.

What is claimed is:

1. A control circuit for activating an X-ray tube to produce a succession of X-ray emissions of like intensity comprising, in combination:

a plurality of capacitors for supplying high voltage to activate said X-ray tube;

first changeover switch means for sequentially connecting said capacitors with said tube to supply an activating voltage thereto;

a voltage source for supplying a charging voltage;

second changeover switch means for sequentially connecting said voltage source with said capacitors to supply charging voltage to the latter, said first and second changeover switch means being operated in synchronized relation to alternately connect each said capacitor first to said voltage source and then to said tube to supply said tube with a succession of high voltage pulses; and first voltage supply interrupting means connected in circuit with said X-ray tube and including first voltage sensitive switching means for sensing the voltage supplied through said first changeover switch means and for interrupting said X-ray tube circuit when said voltage drops below a prescribed threshold value.

2. The control circuit set forth in claim 1 wherein said voltage source comprises a high voltage transformer and a rectifier connected to the secondary winding of said high voltage transformer.

3. The control circuit set forth in claim 1 further comprising second voltage supply interrupting means connected between said voltage source and said second changeover switch means and including second voltage sensitive switching means for sensing the voltage across the capacitor being charged through said second changeover switch means and for interrupting the charging thereof when said voltage rises above a prescribed threshold value.

4. The control circuit set forth in claim 3 further comprising high voltage switch means in circuit with said X-ray tube, said high voltage switch means being operated in synchronized relation with said first changeover switch means to close said tube circuit after each voltage supply capacitor is connected thereto, thereby initiating the emission of X-rays from said tube.

5. The control circuit set forth in claim 3 wherein the prescribed threshold value established by said first volrage sensitive switching means is lower than the prescribed threshold value established by said second voltage sensitive switching means.

* * * * *